US007241205B2

(12) United States Patent
Toyota et al.

(10) Patent No.: US 7,241,205 B2
(45) Date of Patent: Jul. 10, 2007

(54) METHOD OF PROCESSING A SUBSTRATE

(75) Inventors: Gen Toyota, Yokohama (JP); Atsushi Shigeta, Fujisawa (JP); Hiroyuki Yano, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 112 days.

(21) Appl. No.: 11/085,495

(22) Filed: Mar. 22, 2005

(65) Prior Publication Data

US 2005/0245174 A1 Nov. 3, 2005

(30) Foreign Application Priority Data

Mar. 24, 2004 (JP) ..... 2004-087418

(51) Int. Cl.
*B24B 1/00* (2006.01)

(52) U.S. Cl. ..... 451/44; 451/296; 451/301; 451/491; 451/513; 451/535

(58) Field of Classification Search ..... 451/41, 451/44, 59, 296, 301, 307, 491, 513, 514, 451/535

See application file for complete search history.

(56) References Cited

U.S. PATENT DOCUMENTS

| | | | | |
|---|---|---|---|---|
| 2,309,456 | A * | 1/1943 | Hoskin et al. | 451/535 |
| 5,181,347 | A * | 1/1993 | Green | 451/502 |
| 5,289,661 | A * | 3/1994 | Jones et al. | 451/44 |
| 6,062,953 | A * | 5/2000 | Takaya et al. | 451/41 |
| 6,066,031 | A * | 5/2000 | Noguchi et al. | 451/44 |
| 6,306,016 | B1 * | 10/2001 | Steere et al. | 451/44 |
| 6,439,969 | B1 * | 8/2002 | Koma et al. | 451/41 |
| 6,881,130 | B1 * | 4/2005 | Stocker | 451/44 |
| 6,885,539 | B1 * | 4/2005 | Devoe et al. | 451/41 |
| 6,913,513 | B2 * | 7/2005 | Kimura et al. | 451/6 |
| 6,913,526 | B2 * | 7/2005 | Honda | 451/232 |
| 6,933,234 | B2 * | 8/2005 | Nakamura et al. | 438/690 |
| 6,976,901 | B1 * | 12/2005 | Halley et al. | 451/6 |
| 2001/0041513 | A1 * | 11/2001 | Nishi et al. | 451/44 |
| 2004/0106363 | A1 * | 6/2004 | Ishii et al. | 451/65 |
| 2004/0142641 | A1 * | 7/2004 | Ohno et al. | 451/41 |
| 2004/0185751 | A1 * | 9/2004 | Nakanishi et al. | 451/5 |
| 2005/0272359 | A1 * | 12/2005 | Pontieri | 451/495 |

FOREIGN PATENT DOCUMENTS

| | | |
|---|---|---|
| JP | 07-052014 | 2/1995 |
| JP | 2001-205549 | 7/2001 |
| JP | 2003-234314 | 8/2003 |
| JP | 2004-103825 | 4/2004 |

* cited by examiner

*Primary Examiner*—Eileen P. Morgan
(74) *Attorney, Agent, or Firm*—Finnegan, Henderson, Farabow, Garrett & Dunner, L.L.P.

(57) ABSTRACT

A method of processing a substrate is disclosed, wherein a sidewall surface of a notch portion formed in a circumferential portion of a substrate to be processed is polished by using a cylindrical polishing head rotatable with an axis as a rotational center.

5 Claims, 4 Drawing Sheets

METHOD OF PROCESSING A SUBSTRATE

CROSS-REFERENCE TO RELATED APPLICATIONS

This application is based upon and claims the benefit of priority from prior Japanese Patent Application No. 2004-087418, filed Mar. 24, 2004, the entire contents of which are incorporated herein by reference.

BACKGROUND OF THE INVENTION

1. Field of the Invention

The present invention relates to a method of processing a substrate for removing surface roughness that occurs on a circumferential portion of a substrate to be processed, such as a semiconductor wafer, and films that adhere onto the circumferential portion of the substrate to be processed to become stain sources, and more specifically, the invention relates to a method of processing a substrate for polishing a substrate sidewall surface of a notch portion in a substrate to be processed.

2. Description of the Related Art

In recent years, along with the miniaturization of semiconductor elements and the high packing density of semiconductor devices, management of particles has become more important. As one of the big problems in managing particles, there is the problem of dust occurrence arising from surface roughness that occurs on bevel portions and edge portions of a semiconductor wafer (semiconductor substrate) in processes of manufacturing a semiconductor device. Herein, the bevel portion means a wafer portion having a slanted cross section at an end portion of the semiconductor wafer, and the edge portion means a flat surface wafer portion of around several millimeters from the bevel portion toward the internal side of the wafer.

For example, in a reactive ion etching (RIE) step of forming trenches (deep trenches) of a trench capacitor on a surface of an Si wafer, a by-product generated in etching adheres to the circumferential portion (bevel portions and edge portions) of the wafer. Then, because this by-product works as an etching mask, thorn-shaped protrusions are likely to be formed on the circumferential portion of the wafer (protrusions shown by reference numeral 35 in FIG. 4). In particular, when attempt is made to form an extremely large deep trench whose opening diameter is of a sub micron order, and whose aspect ratio is several tens, the above-mentioned thorn-shaped protrusions are apt to occur at the circumferential portion due to its process conditions.

Although the height of the thorn-shaped protrusions varies with positions on the wafer, it becomes near 10 μm at maximum, and these protrusions are broken at the time of transfer or process of the wafer, and become a cause of particles. Since such particles lead to the decrease of the yield of a semiconductor device being manufactured, it is necessary to remove the thorn-shaped protrusions formed on the circumferential portion of the wafer. Further, in processes of manufacturing a semiconductor device, material films adhering to the circumferential portion of the wafer also become stain sources, and therefore, it is required to remove these material films.

In order to remove such thorn-shaped protrusions and material films, a chemical dry etching (CDE) method and a polishing method are employed. Particularly, in the polishing method, it is advantageous that surface roughness that occurs on the wafer circumferential portion and material films that adhere onto the wafer circumferential portion to become sources of stain can be removed in a short time.

Incidentally, on part of a wafer circumference, as an alignment mark for alignment with a mask, further as a crystal orientation recognition mark for recognizing the crystal orientation on a main surface of the wafer, a cut called "notch" is made in some cases. It is necessary to polish a substrate sidewall surface of the notch portion as well as the circumferential portion.

With regard to polishing of the substrate sidewall surface of the notch portion, a method in which a polishing agent is moved upward and downward in the vertical direction to the wafer surface (horizontal direction) while being contacted and pressed onto the substrate sidewall surface of the notch portion has been most generally used currently. However, in this method, by the contact and pressing to the substrate sidewall surface, further, by the upward and downward movement of the polishing agent to the substrate sidewall surface that is carried out in the vertical direction to the wafer surface, there may be a crystal defect in the wafer. As a result, there may occur a problem in the reliability of a semiconductor device being manufactured. Further, the method has decreased the yield, which has been a problem with the prior art.

On the other hand, there has been disclosed a method in which a polishing head with a shaft in the vertical direction to the wafer surface as its rotational center is applied onto a substrate sidewall surface of a notch portion and the polishing head is rotated to thereby polish the substrate sidewall surface of the notch portion (as disclosed in, for example, Jpn. Pat. Appln. KOKAI Publication No. 2003-234314). Specifically, a grinding stone wheel that has a slot corresponding to the shape of a bevel portion of a wafer is used, and with the slot of the wheel engaged into a circumferential portion of the wafer, the wheel is rotated to thereby polish the substrate sidewall surface of the notch portion. In this method, since the wheel is rotated with a shaft in the vertical direction to the wafer surface as its rotational center, no force in the vertical direction is applied to the wafer, and a crystal defect hardly occurs on the wafer.

However, this method has had the following problem. Namely, because the slot shape of the grinding stone wheel is made to meet the shape of the bevel portion, the general versatility of this method to various kinds of wafers is inevitably low. Further, only the slot portion of the grinding stone wheel is employed as a polishing portion. Therefore, deterioration of the slot inside is large and the durability thereof is insufficient, and when it is deteriorated to some extent, the wheel must be exchanged with a new one, and this will decrease work efficiency, which has been another problem with the prior art.

BRIEF SUMMARY OF THE INVENTION

According to an aspect of the present invention, there is provided a method of processing a substrate, wherein a sidewall surface of a notch portion formed in a circumferential portion of a substrate to be processed is polished by using a cylindrical polishing head rotatable with an axis as a rotational center.

According to another aspect of the present invention, there is provided a method of processing a substrate, wherein a sidewall surface of a notch portion formed in a circumferential portion of a substrate to be processed is polished by slide of a polishing agent, which is provided above a peripheral surface of a polishing head through an elastic member, in the same direction as a surface of the substrate.

DETAILED DESCRIPTION OF THE INVENTION

Embodiments of the present invention will be explained by reference to the accompanying drawings.

FIRST EMBODIMENT

Figure 1:
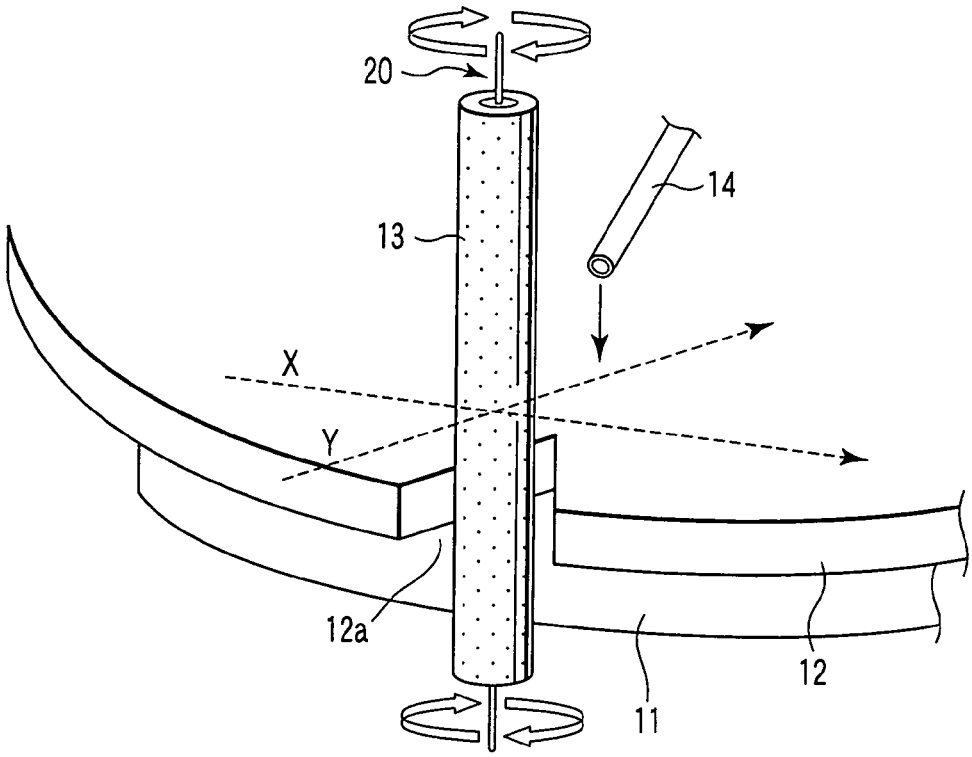
FIG. 1 is a schematic perspective view showing a constitution of a polishing device for use in substrate processing by a substrate processing method according to a first embodiment of the present invention.

FIG. 1 is a schematic perspective view showing a constitution of a polishing device for use in substrate processing by a substrate processing method according to a first embodiment of the present invention.

In FIG. 1, reference numeral 11 is a substrate holding table, and on the substrate holding table 11, a substrate 12 to be processed such as a semiconductor wafer is held with its substrate surface in the horizontal direction. The diameter of the substrate holding table 11 is smaller than that of the substrate 12, and therefore, a circumferential portion of the substrate 12 protrudes further outward than the substrate holding table 11. Further, a notch portion 12*a* formed in the circumferential portion of the substrate 12 is positioned outward than the substrate holding table 11.

In addition, reference numeral 13 in FIG. 1 is a cylindrical polishing head mechanism that is arranged so as to rotate with a shaft (axis) 20 in the vertical direction to the surface (horizontal direction) of the substrate 12 as its rotational center. The polishing head mechanism 13 is movable in the horizontal direction (X and Y directions), and the angle of the shaft 20 may be arbitrarily changed in the X and Y directions. In a state where the polishing head mechanism 13 is contacted and pressed onto a substrate sidewall surface of the notch portion 12*a*, the polishing head mechanism 13 is rotated to polish the sidewall surface of the notch portion 12*a*.

Further, reference numeral 14 in FIG. 1 is a pure water supply nozzle, and pure water is supplied from the pure water supply nozzle 14 to a contact portion between the substrate 12 and the polishing head mechanism 13. In the place of pure water, a chemical solution such as a polishing liquid may be also employed.

Figure 2:
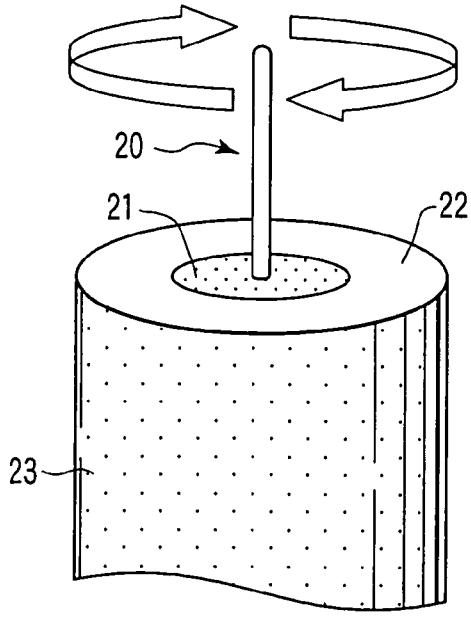
FIG. 2 is an enlarged perspective view showing a constitution of a polishing head portion of the polishing device shown in FIG. 1.

FIG. 2 is an enlarged perspective view showing a constitution of the polishing head mechanism 13 of the polishing device shown in FIG. 1.

A cylindrical polishing head 21 is arranged so as to rotate with the vertical shaft 20 as its rotational center, an elastic member 22 is attached on a side surface of the polishing head 21, and further, a polishing tape 23 is attached on the elastic member 22. The axial length of the polishing head 21 is, for example, 10 cm, and is far longer than the thickness of the substrate 12 to be processed.

As the elastic member 22, for example, natural rubber, silicone rubber, urethane rubber, butyl rubber, polyvinyl alcohol and the like may be employed.

A polishing surface of the polishing tape 23 is made of, for example, a thin PET film of about several microns to several hundreds of microns in thickness. As the polishing tape 23, a tape having, for example, diamond grinding particles and SiC adhered on a polishing surface thereof by an urethane type adhesive may be employed. Grinding particles to be adhered onto the polishing tape 23 are selected according to the kinds of substrates to be processed and required performances thereof, and for example, diamond with the particle size of #2000 to #30000 and SiC with the particle size of #2000 to #20000 may be employed.

Next, a substrate processing method by use of the polishing device of the above constitution will be explained by reference to FIGS. 3 to 7. Herein, a method is explained in which deep trenches of a trench capacitor are formed in a surface of an Si wafer by an RIE method, and roughness that occurs on a surface of a notch portion of the wafer at this moment is removed. Note that the notch portion is of course in the circumferential portion of the wafer, and in the wafer cross sections shown in FIGS. 3 to 7, the cross sectional shape of the notch portion is made the same as the cross sectional shape of other wafer circumferential portion than the notch portion. Namely, there are bevel portions and edge portions also in the notch portion.

Figure 3:
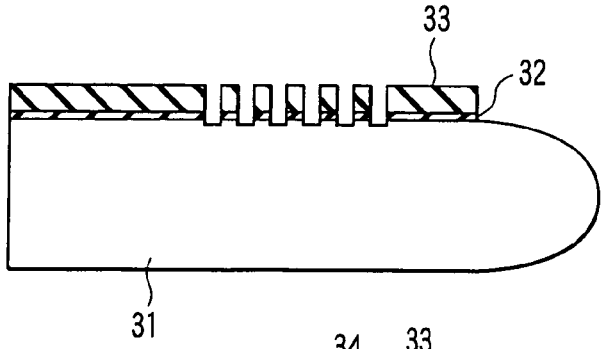
FIG. 3 is a cross sectional view showing a substrate structure in a step of a substrate processing method according to the first embodiment, for explaining the substrate processing method.

First, as shown in FIG. 3, a hard mask composed of laminated films of an $SiO_2$ film 32 and an SiN film 33 is formed on an Si wafer 31. Herein, the thickness of the $SiO_2$ film 32 is, for example, 90 nm, and the thickness of the SiN film 33 is, for example, 200 nm.

Figure 4:
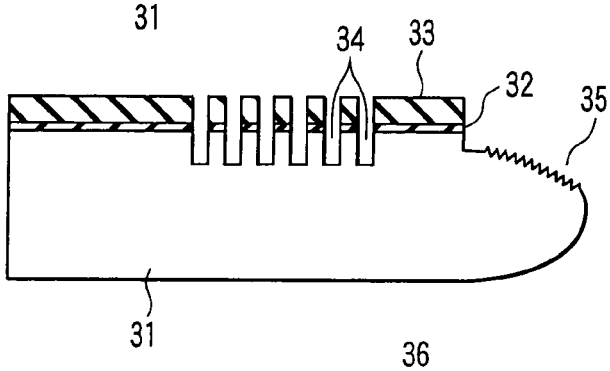
FIG. 4 is a cross sectional view showing a substrate structure in a step following the step of FIG. 3 of a substrate processing method according to the first embodiment, for explaining the substrate processing method.

Next, as shown in FIG. 4, with the hard mask as a mask, the Si wafer 31 is etched by the RIE method, and deep trenches 34 are formed in the Si wafer 31. For example, the opening diameter of the deep trenches is 0.25 μm, and the depth thereof is 7 μm. By the RIE process, thorn-shaped protrusions 35 are formed on a surface of a circumferential portion of the Si wafer 31.

In more details, a by-product generated in the etching adheres to the bevel portions and edge portions of the notch portion of the Si wafer 31. Then, because this by-product works as an etching mask, thorn-shaped protrusions are formed on the bevel portions and edge portions of the Si wafer 31. In particular, when attempt is made to form an extremely large deep trench 34 whose opening diameter is of a sub micron order, and whose aspect ratio is several tens, the thorn-shaped protrusions 35 are apt to occur at the bevel portions and edge portions due to its process conditions. In the present embodiment, the thorn-shaped protrusions 35 are removed by using the polishing device mentioned above.

Figure 5:
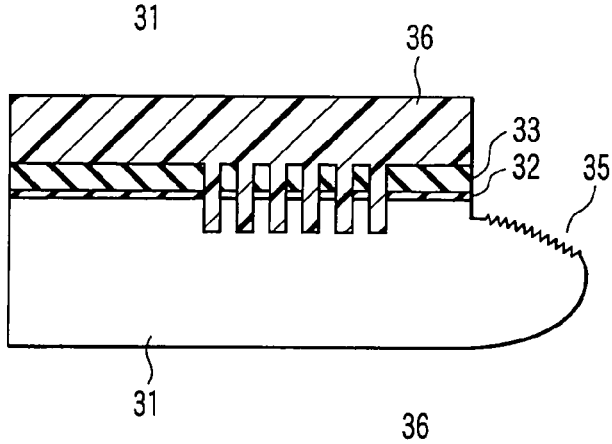
FIG. 5 is a cross sectional view showing a substrate structure in a step following the step of FIG. 4 of a substrate processing method according to the first embodiment, for explaining the substrate processing method.

Before polishing, for the purpose of protection of the substrate surface, a resist 36 is applied onto the Si wafer 31 except the bevel portions and the edge portions as shown in FIG. 5. The resist 36 also has a function of preventing polishing particles and Si generated particles by polishing, to be described later, from entering the trenches 34.

With the structure shown in FIG. 5 as the substrate 12 to be processed, the substrate 12 is held on the substrate holding table 11 of the polishing device shown in FIG. 1. Then, the polishing head mechanism 13 is moved into the notch portion of the substrate 12, and the polishing head mechanism 13 is pressed to the substrate 12. The shaft 20 of the polishing head mechanism 13 is set in the vertical direction to the surface (horizontal direction) of the substrate 12. When the polishing head mechanism 13 is pressed to the substrate 12, the elastic member 22 of the polishing head mechanism 13 is deformed by the pressing force, and in correspondence with this, the polishing tape 23 is deformed. As a consequence, the polishing tape 23 of the polishing head mechanism 13 is abutted to the sidewall surface of the notch portion under uniform pressure. Then, when the polishing head mechanism 13 is rotated, the sidewall surface of the notch portion and the polishing tape 23 are contacted so as to slide to each other, and the sidewall surface of the notch portion of the substrate 12 is polished. At this moment, pure water is supplied from the pure water supply nozzle 14 to the contact portion of the sidewall surface of the notch portion of the substrate 12 and the polishing tape 23.

Next, in order to polish the entire substrate sidewall surface of the notch portion, while the shaft 20 of the polishing head mechanism 13 is held in the vertical direction, and while the polishing head mechanism 13 is held in its rotating state, the polishing head mechanism 13 is moved on the sidewall surface of the notch portion in the direction along the surface of the substrate 12 (X and Y directions shown in FIG. 1).

Note that, in polishing of the sidewall surface of the notch portion in order to ensure to polish not only the bevel portions but also the edge portions, polishing may be carried out by changing the angles of the shaft 20 of the polishing head mechanism 13 into desired angles in the X and Y directions. Further, in the case there is decrease in the performance of the polishing tape 23 after a certain amount of polishing, the polishing head mechanism 13 is slightly shifted in the axial direction, a fresh tape surface portion is positioned at the substrate sidewall surface of the notch portion and polishing is continued by use of the fresh tape surface portion.

Figure 6:
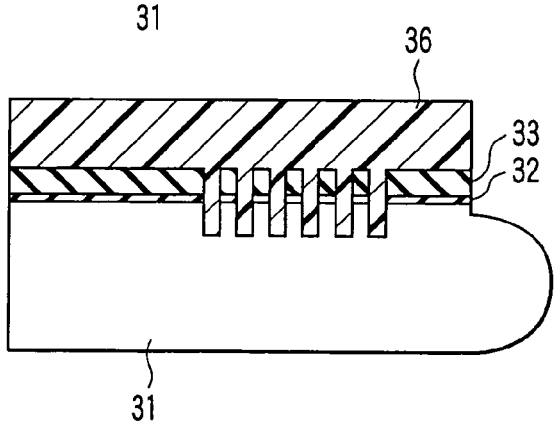
FIG. 6 is a cross sectional view showing a substrate structure in a step following the step of FIG. 5 of a substrate processing method according to the first embodiment, for explaining the substrate processing method.

Through the above polishing process, as shown in FIG. 6, there is no protrusion on the circumferential portion of the Si wafer 31, and a flat surface is obtained. In polishing of the sidewall surface of the notch portion of the substrate 12, the sliding direction of the sidewall surface at the notch portion and the polishing tape 23 is set in the direction along the wafer surface, and thus, no crystal defect occurs on the wafer 31. Note that the wafer circumferential portion other than the notch portion may be polished by the polishing device shown in FIG. 1, and, the other wafer circumferential portion than the notch portion may be polished by use of another polishing device.

Figure 7:
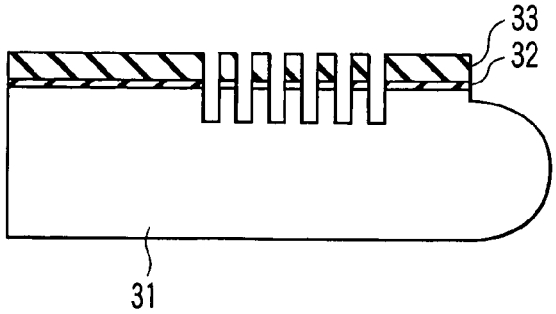
FIG. 7 is a cross sectional view showing a substrate structure in a step following the step of FIG. 6 of a substrate processing method according to the first embodiment, for explaining the substrate processing method.

Thereafter, a physical cleaning process such as brush scrubbing or ultrasonic cleaning is carried out to the substrate surface to remove particles and other extraneous matters adhering to the surface of the resist 36. In the case of the present embodiment, because the substrate surface is protected by the resist 36, the particles and other extraneous matters adhering to the surface of the resist 36 may be removed by use of chemical etching in the place of the physical cleaning process. Thereafter, as shown in FIG. 7, the resist 36 is removed by an ashing process using oxygen gas or the like.

As described above, according to this embodiment, with respect to the Si wafer 31 having deep trenches of a trench capacitor formed thereon by the RIE method, when the notch portion thereof is to be polished, the cylindrical polishing head mechanism 13 is employed. In the state were the polishing head mechanism 13 is contacted and pressed onto the sidewall surface of the notch portion, the polishing head mechanism 13 is rotated, so that the sidewall surface of the notch portion can be polished by sliding in the horizontal direction. Accordingly, it is possible to carry out a preferable polishing process while preventing crystal defects from occurring on the substrate 12 to be processed, and as a consequence, it is possible to improve the reliability and yield of the semiconductor device to be manufactured.

Further, the elastic member 22 is arranged to the polishing head mechanism 13 and thereby the polishing portion thereof is made so as to have flexibility. As a consequence, it is possible to remove unevenness of pressure on the contact surface and make the polishing amount uniform even if curvature radius of the notch portion is varied.

Moreover, because the polishing head 21 is cylindrical, by moving the polishing head mechanism 13 in the axial direction, polishing can be carried out by using a fresh polishing surface portion. Accordingly, the polishing head 21 can be used for a long time, thereby reducing the manufacturing costs.

SECOND EMBODIMENT

Figure 8:
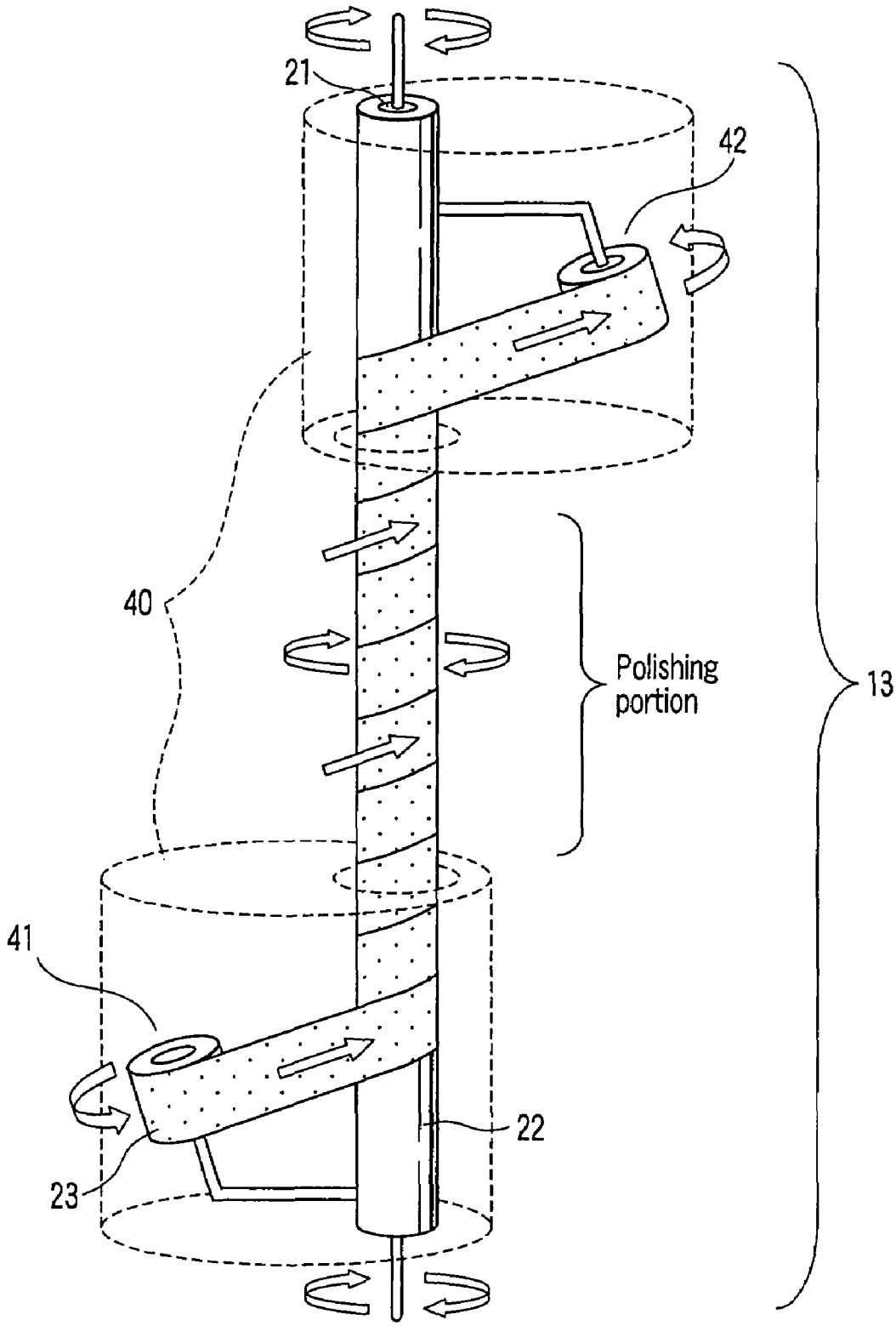
FIG. 8 is a schematic perspective view showing a constitution of a polishing device for use in substrate processing by a substrate processing method according to a second embodiment of the present invention.
Figure 9:
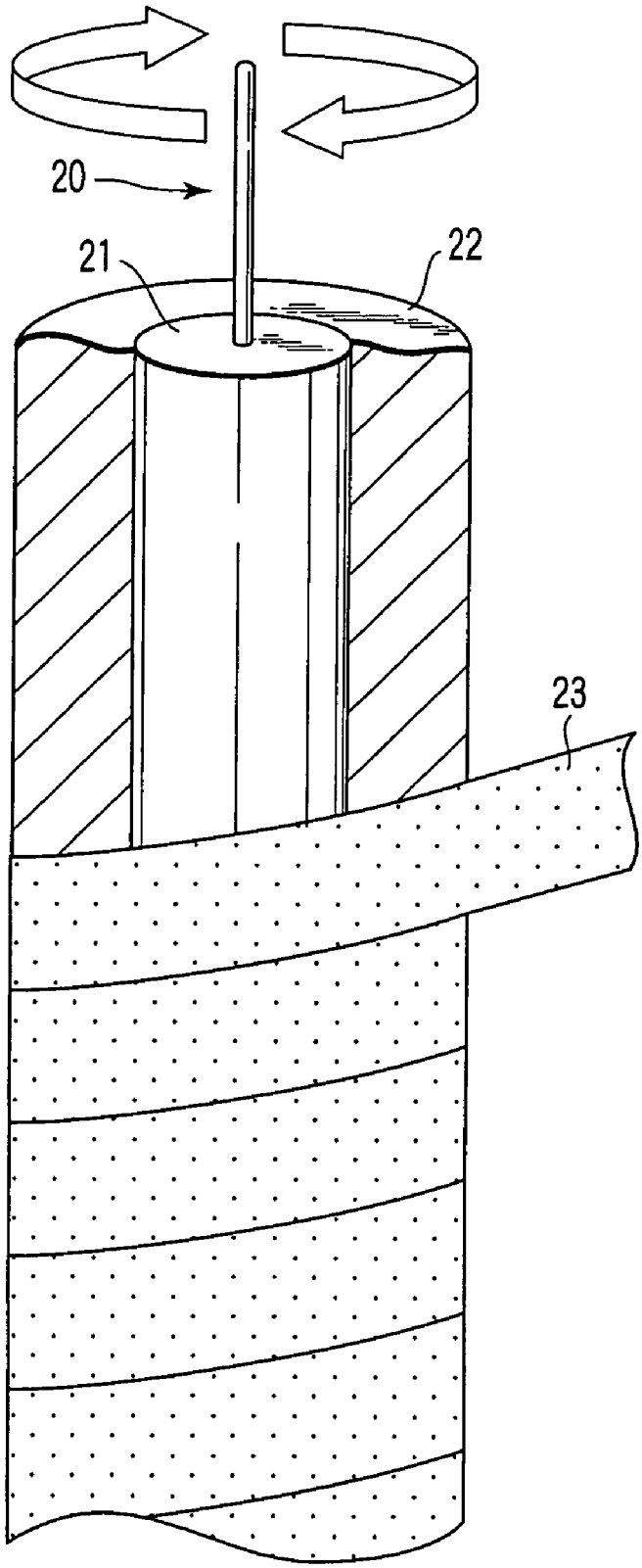
FIG. 9 is an enlarged schematic perspective view showing a portion of the constitution of the polishing device shown in FIG. 8, in which an elastic member is partly cut away.

FIG. 8 is a schematic perspective view showing a constitution of a polishing device for use in substrate processing by a substrate processing method according to a second embodiment of the present invention. FIG. 9 is an enlarged schematic perspective view showing a portion of the constitution of the polishing device shown in FIG. 8, in which the elastic member 22 is partly cut away. In the polishing device, a fresh polishing tape is supplied and an old polishing tape is wound at every polishing process. The same components as those shown in FIG. 1 are denoted by the same reference numerals, and the detailed description thereof is omitted.

A polishing tape supply and winding mechanism 40 is provided to a cylindrical polishing head 21. Specifically, a supply unit 41 is attached at the lower portion of the cylindrical polishing head 21, and a winding unit 42 is attached at the upper portion thereof. The rotating shafts of the supply unit 41 and the winding unit 42 are fixed to the polishing head 21, and move (revolve around the polishing head) as the polishing head 21 rotates, and also rotate by themselves (revolve on their own axes).

A polishing tape 23 is adhered spirally onto the surface of the polishing head 21, and an unused portion thereof is wound around the supply unit 41, and the used portion thereof is wound around the winding unit 42. Further, the rotational action of the polishing head 21 itself and the polishing tape supply and winding action by the polishing tape supply and winding mechanism 40 may be carried out individually.

It is also possible to polish the notch portion 12*a* (FIG. 1) of the substrate 12 in the same manners as in the first embodiment by use of the device shown in FIG. 8. In the device shown in FIG. 8, the polishing tape 23 at the polishing surface can be exchanged without moving the polishing head 21 in the axial direction thereof. Accordingly, by making the length of the polishing tape 23 sufficiently long, a polishing surface corresponding to a larger area than the area of the entire circumferential surface of the polishing head 21 may be used, and therefore, it is possible to further improve the durability as a polishing head mechanism.

MODIFIED EMBODIMENTS

The present invention is not limited to the embodiments described above. In the embodiments, by the sliding action of the polishing tape adhered to the polishing head, the substrate sidewall surface of the notch portion is polished. However, in place of the polishing tape, a polishing pad or a polishing cloth may be employed as a polishing material, and in place of pure water, a polishing agent including polishing particles may be used to polish the notch portion of the substrate.

Further, in the above embodiments, an example in which the Si wafer is used as the substrate has been explained, but, in place thereof, semiconductor wafers such as an SOI wafer and an SiGe wafer may be employed. Further, an Si wafer whose device formation surface is formed of SiGe may be employed. That is, owing to the arrangement of an elastic material member on the peripheral surface of the polishing head, which is deformable when the polishing head mechanism is pressed onto the sidewall surface of the notch portion, it is possible to deform the polishing tape so as to conform with the shape of the sidewall surface of the notch portion so that the polishing tape abuts on the sidewall surface of the notch portion. Accordingly, the polishing head mechanism has high general versatility to various kinds of wafers.

Furthermore, for the purpose of protection of the substrate surface, other organic films than a resist may be employed. In addition, after completion of polishing, it is not necessary to remove all of the organic film, but only part of the stained surface thereof may be removed, and the remaining portion of the organic film may be used as a protective film in the later processes.

According to the above-described embodiments, a cylindrical polishing head is used, and the polishing head is rotated with the shaft as the rotational center, which is perpendicular to the surface of a substrate to be processed, thereby polishing the sidewall surface of the notch portion. In this case, the sliding direction of the sidewall surface of the notch portion and the polishing head is not in the vertical direction but in the horizontal direction to the substrate surface. Accordingly, since an upward and downward force is not applied to the sidewall surface of the notch portion, it is possible to prevent crystal defects from entering the substrate. Further, because the polishing head is cylindrical, the entire circumferential surface of the polishing head can be used as a polishing surface, thereby improving the durability of the polishing head, and also improving the work efficiency.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method of processing a substrate, comprising:

preparing a rotatable polishing mechanism with a rotatable cylindrical polishing head and a polishing tape supply and winding device, the polishing tape supply and winding device being movable with the polishing head and having a polishing tape supply unit and a polishing tape winding unit, and a polishing tape supplied from the polishing tape supply unit being spirally wound on the polishing head;

placing the polishing head in a notch formed in a circumferential portion of a substrate to be processed; and rotating the polishing head while contacting and pressing the polishing head on a sidewall surface of the notch to polish the sidewall surface of the notch, wherein during the polishing by the polishing tape, an unused tape portion of the polishing tape is supplied from the polishing tape supply unit to the polishing head and wound on the polishing head and, concurrently, a used tape portion of the polishing tape wound on the polishing head is removed from the polishing head by the polishing tape winding unit, so that unused tape portions of the polishing tape are supplied during the polishing without moving the polishing head up or down.

2. The method of processing a substrate according to claim 1, wherein, during the polishing, pure water or a chemical solution is supplied between the polishing head and the sidewall surface of the notch.

3. The method of processing a substrate according to claim 1, wherein an elastic member is provided between the polishing head and the polishing tape.

4. The method of processing a substrate according to claim 3, wherein the elastic member is made of natural rubber, silicone rubber, urethane rubber, butyl rubber, or polyvinyl alcohol.

5. The method of processing a substrate according to claim 1, wherein the polishing head is inclined so that the polishing head is shifted by a predetermined angle from a direction substantially perpendicular to a surface of the substrate.

* * * * *